US006550176B2

(12) United States Patent
Beretta

(10) Patent No.: US 6,550,176 B2
(45) Date of Patent: Apr. 22, 2003

(54) PERFECTED MECHANICAL SAFETY DEVICE FOR LIGHT FIREARMS SUCH AS SEMIAUTOMATIC RIFLES

(75) Inventor: Ugo Gussalli Beretta, Brescia (IT)

(73) Assignee: Fabbrica d'Armi Pietro Beretta S.p.A. (IT)

( * ) Notice: Subject to any disclaimer, the term of this patent is extended or adjusted under 35 U.S.C. 154(b) by 0 days.

(21) Appl. No.: 10/146,308

(22) Filed: May 15, 2002

(65) Prior Publication Data

US 2002/0194764 A1 Dec. 26, 2002

(51) Int. Cl.[7] ..... F41A 17/02

(52) U.S. Cl. ..... 42/70.11; 42/70.04; 42/70.05; 42/70.06; 42/70.07; 42/70.08; 42/90; 42/96

(58) Field of Search ..... 42/70.04, 70.05, 42/70.06, 70.07, 70.08, 70.11, 90, 96

(56) References Cited

U.S. PATENT DOCUMENTS

| | | | | | |
|---|---|---|---|---|---|
| 1,227,531 | A | * | 5/1917 | Donadio | |
| 2,453,683 | A | * | 11/1948 | Caldow | 42/70 |
| 4,995,180 | A | * | 2/1991 | Tucker et al. | 42/70.07 |
| 5,068,990 | A | * | 12/1991 | Marzocco | 42/70.04 |
| 5,068,991 | A | * | 12/1991 | Reed | 42/71.01 |
| 6,141,896 | A | * | 11/2000 | Oberst | 42/70.06 |
| 6,173,518 | B1 | * | 1/2001 | Oberst | 42/70.06 |
| 6,212,812 | B1 | * | 4/2001 | Aigner | 42/70.06 |
| 6,256,917 | B1 | * | 7/2001 | Findlay | 42/70.06 |
| 6,389,726 | B1 | * | 5/2002 | Bentley | 42/70.06 |
| 6,405,471 | B1 | * | 6/2002 | Mauch | 42/66 |

FOREIGN PATENT DOCUMENTS

| | | | |
|---|---|---|---|
| GB | 0004431 | * | 9/1910 |

* cited by examiner

*Primary Examiner*—Michael J. Carone
*Assistant Examiner*—John Richardson
(74) *Attorney, Agent, or Firm*—McGlew and Tuttle, P.C.

(57) ABSTRACT

This invention concerns a perfected mechanical safety device for firearms such as automatic shotguns equipped with a safety device in the under-barrel grip where the safety device includes at least one safety pin or rod (11) that is axially moveable between an active position of disabling use of the firearm and an inactive position of enabling use of the firearm and, in association with his safety pin, at least one spring-loaded selector element (13, 14) that defines the said active and inactive positions of the safety pin, alternately, characterized by a safety body turning around an axis intersecting the moving direction of the safety pin between a position of locking the safety pin, thus inhibiting its movement from the active to inactive position, and unlocking it to permit movement from the active to the inactive position, the said safety body being enabled by a specific control key.

9 Claims, 4 Drawing Sheets

PERFECTED MECHANICAL SAFETY DEVICE FOR LIGHT FIREARMS SUCH AS SEMIAUTOMATIC RIFLES

FIELD OF THE INVENTION

This invention concerns light firearms, in particular but not exclusively semiautomatic rifles equipped with a safety catch at the level of the under-barrel grip.

STATE OF TECHNIQUE

Firearms are usually provided with a hand-operated safety catch that has the function of preventing the gun going off accidentally or involuntarily, impeding functioning and/or activation of the firing mechanism or a part thereof, directly or indirectly.

On semiautomatic rifles the safety catch may be set transversally in the under-barrel grip. Essentially it consists of a pin, with buttons at the ends, which is moved longitudinally, by pressing the buttons alternatively, from an active safe position in which the arm cannot be fired, to a disabled position in which the firearm may be used. These extreme positions are defined by at least one spring-loaded arrest device or selector connected with the safety catch. Nevertheless, a safety catch of this sort does not efficaciously prevent abuse of the firearm inasmuch as it is accessible to and can be manually activated with ease by anyone, therefore also by unauthorised and incompetent individuals.

At present however there is a demand to equip such firearms with safety devices that can be activated and deactivated only with the use of a specific means, possessed only by the owner of the firearm or someone delegated thereby, with view to effectively preventing use of the firearm by unauthorised persons.

PURPOSES AND SUMMARY OF THE INVENTION

The main purpose of this invention is to propose a hand-operated mechanical safety catch, in particular for semiautomatic rifles, linked to a supplementary safety device which permits stable locking in the active safety position, a locking which may be deactivated only by means of a specific personalised key.

A further purpose of the invention is therefore that of supplying a hand-operated safety device for semiautomatic rifles which, as well as maintaining its structural features, its positioning in the under-barrel grip and its aim of preventing or allowing use of the firearm, can also be deactivated only by the owner of the firearm or by an authorised person in possession of the activating key for the supplementary device.

These purposes and advantages are achieved with a hand-operated mechanical safety catch of the type mentioned above, located in the under-barrel grip of a semiautomatic rifle and moveable axially between an active and inactive position, combined with a supplementary safety device which includes:

a safety device body located and fixed in the under-barrel grip on an axis intersecting the direction of movement of the safety catch pin and rotating around that axis between a position of locking the safety catch pin to prevent its movement from the active to inactive position, and a position of unlocking to permit movement from the active to the inactive position.

a specific command key to engage and turn the safety device body between the said positions of locking and unlocking, and at least one blocking tooth or cam on the safety device body to intercept and axially block the safety catch pin at least in the active position when this safety device body is in the said locked position.

The safety device body is located and turns in a housing in the under-barrel grip and has a bit-key portion for coupling with the command key and at least one additional engaging tooth with respective corresponding parts to define the extreme positions of safety device body locking and unlocking.

Since the under-barrel grip is usually made of a technopolymer, in itself susceptible to attack by cutting and/or breaking tools, it is preferable to sink, in the under-barrel grip, an insert in anti-cutting and anti-drilling steel, and the housing for the safety device is obtained from this insert, thus ensuring suitable toughness for the application.

BRIEF DESCRIPTION OF THE DRAWINGS

Further details of the invention are evident from the following description given with reference to the attached indicative and not limitative drawings in which.

DETAILED DESCRIPTION OF THE INVENTION

Figure 1:
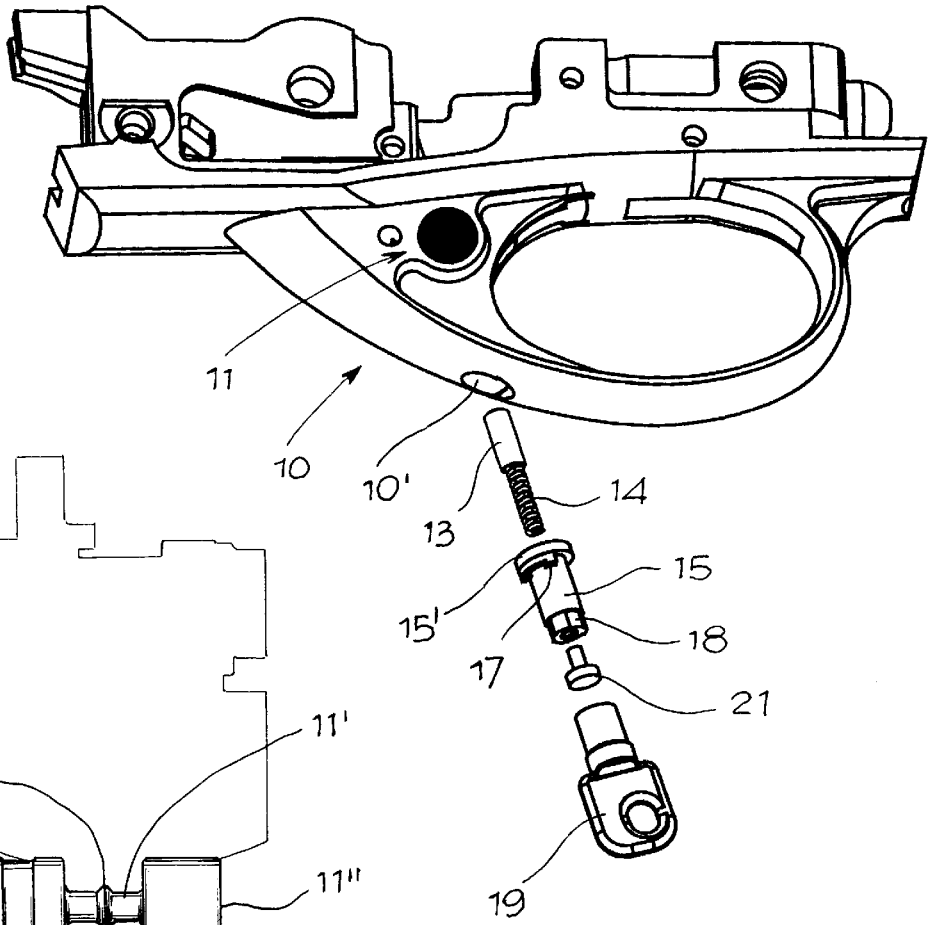
FIG. 1 shows a blow-up view of the safety device components in relation to a under-barrel grip equipped with a hand-operated safety catch.

The said drawings show the under-barrel grip 10 of a semiautomatic rifle in which there is housed, transversally, a hand-operated safety catch 11. This consists, as is well known, of a safety pin or shaft 11' with buttons 11" at the extremities for its usual longitudinal movement from an inactive position, which is to say ready for firing, FIG. 3, or an active position, i.e. safety catch on, FIG. 4, defined by a stop mechanism such as a selector 13. In the example shown, this selector 13 consists of a small spring-loaded piston 14 which interacts with an annular relief along the safety catch pin 11' precisely to arrest the latter in either the inactive or active position.

In the invention the hand-operated safety catch 11 is associated with a supplimentary safety device to lock the safety catch 11 stably at least in its active position. This supplementary device includes a safety device body 15, mounted and rotating in a housing 10' directly created in the under-barrel grip or, preferably, in a steel insert 10" set in the under-barrel grip.

The safety device body 15 is held in the under-barrel grip on an axis intersecting the direction of movement of the safety catch pin 11' and rotates between a position of locking and a position of unlocking the hand-operated safety device 11 by means of a command key 19.

Preferably, as shown in the drawings, but not necessarily, the spring-loaded selector 13, 14 should be placed on board the safety device body, between the latter and the safety catch pin 11' to engage with the annular relief 12 defining the active and inactive positions of the hand operated safety catch.

The safety device body 15 has its head end 15' towards the safety device pin and the opposite end towards the exterior of the under-barrel grip, below. At the head end 15' the safety device body 15 is equipped with at least one arrest tooth or cam 16 which engages and disengages a surface plate on the safety device pin following rotation of the safety device body to the lock and unlock positions respectively. The surface plate may be defined by a button 11" on the safety device pin 11'; in the drawing, for example, the button which must be acted on to shift the safety device pin from the active to the inactive position.

The safety device body is further equipped with at least one additional arrest tooth 17 which engages corresponding arrest notches 17' envisaged in the under-barrel grip housing to establish, though reversibly, the safety device locked and unlocked positions.

At the opposite end the safety device body has a key-bit portion 18 for coupling with command key 19 and includes a revolving terminal 21 to prevent rotation of the body with any tool other than the specific key 19.

Figure 3:
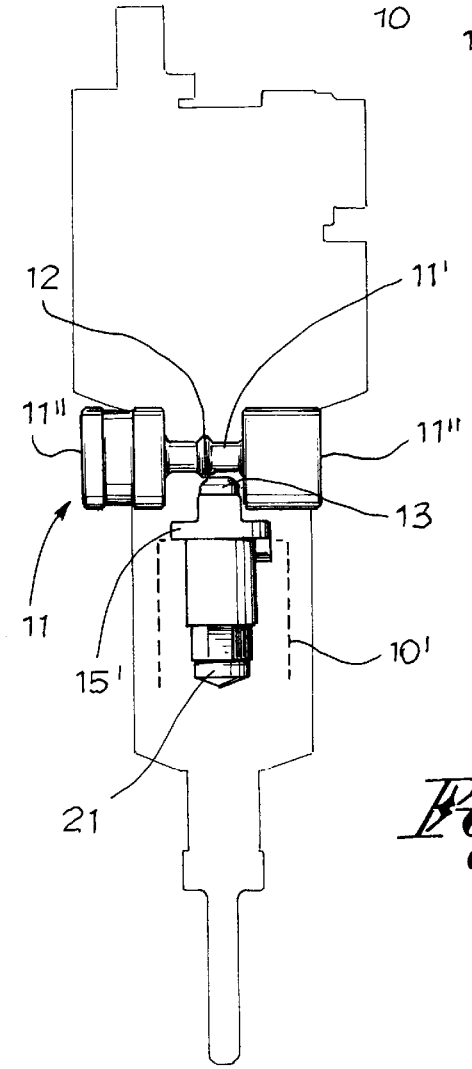
FIGS. 3 and 4 show respectively the hand-operated safety device in the inactive and active positions, and the supplementary safety device in the unlocked inoperative position.
Figure 2:
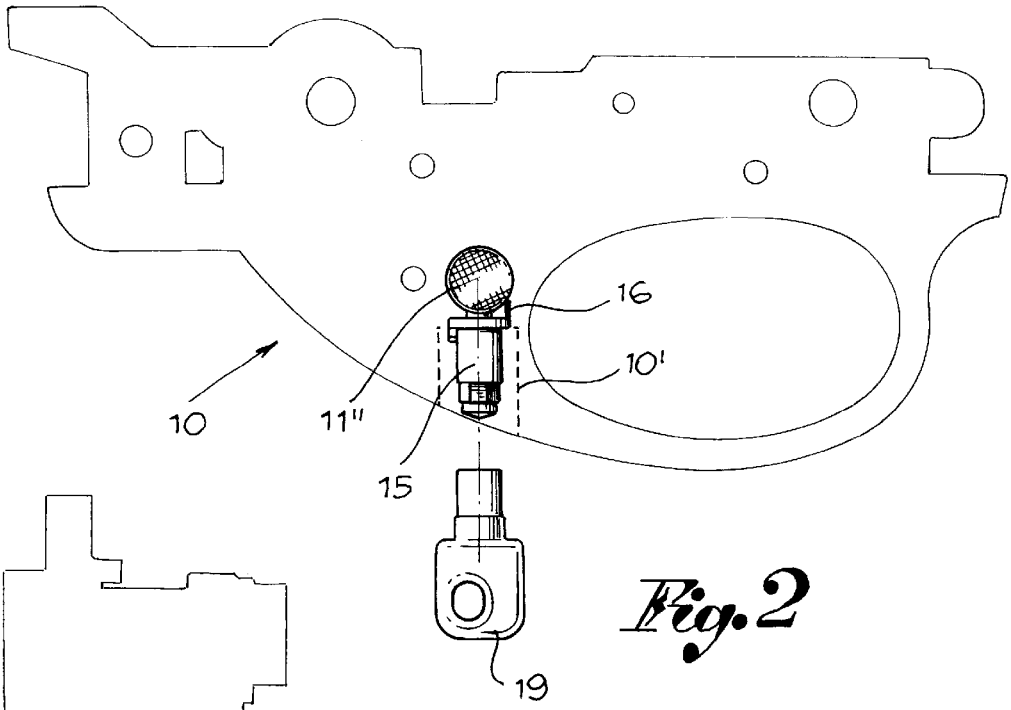
FIG. 2 shows the supplementary safety device of FIG. 1 assembled and inserted into the under-barrel grip.
Figure 4:
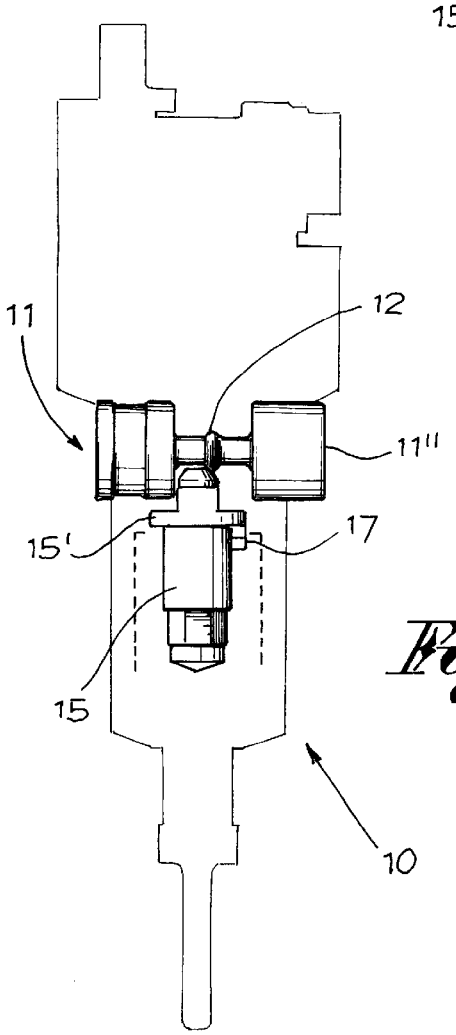
Figure 6:
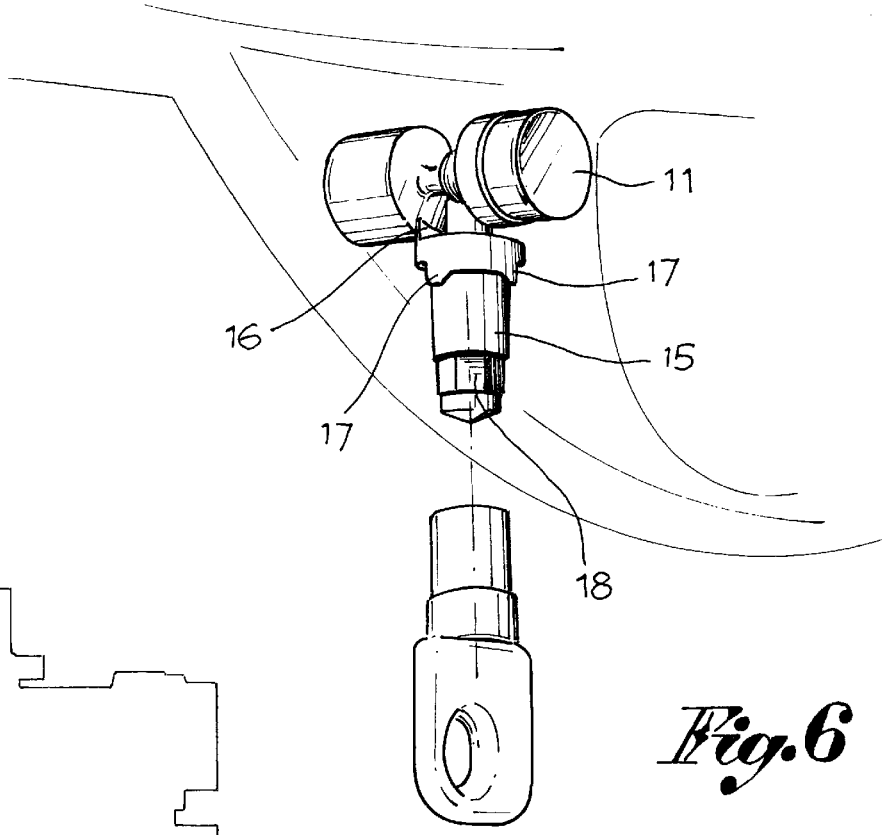
FIGS. 5 and 6 show, in elevation from behind and foreshortened respectively, the hand-operated safety catch in the active position and the supplementary safety device in the operative locking position.
Figure 5:
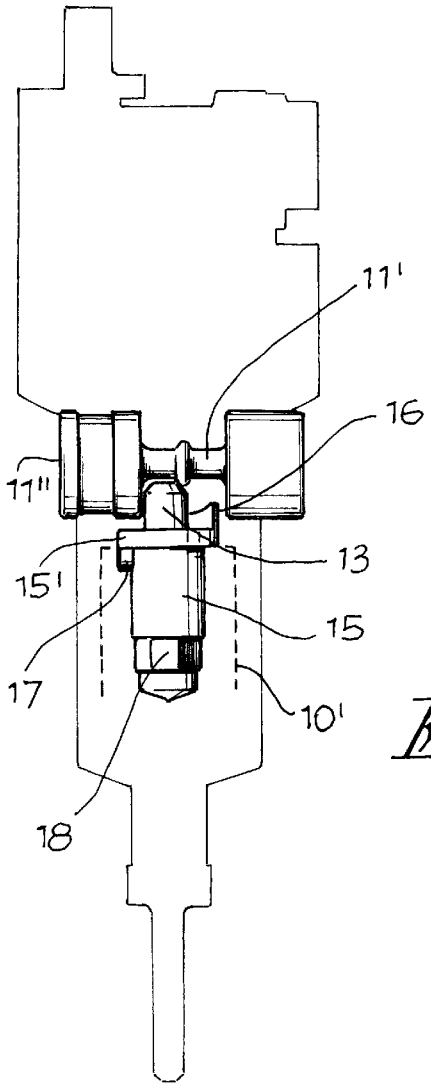
Figure 7:
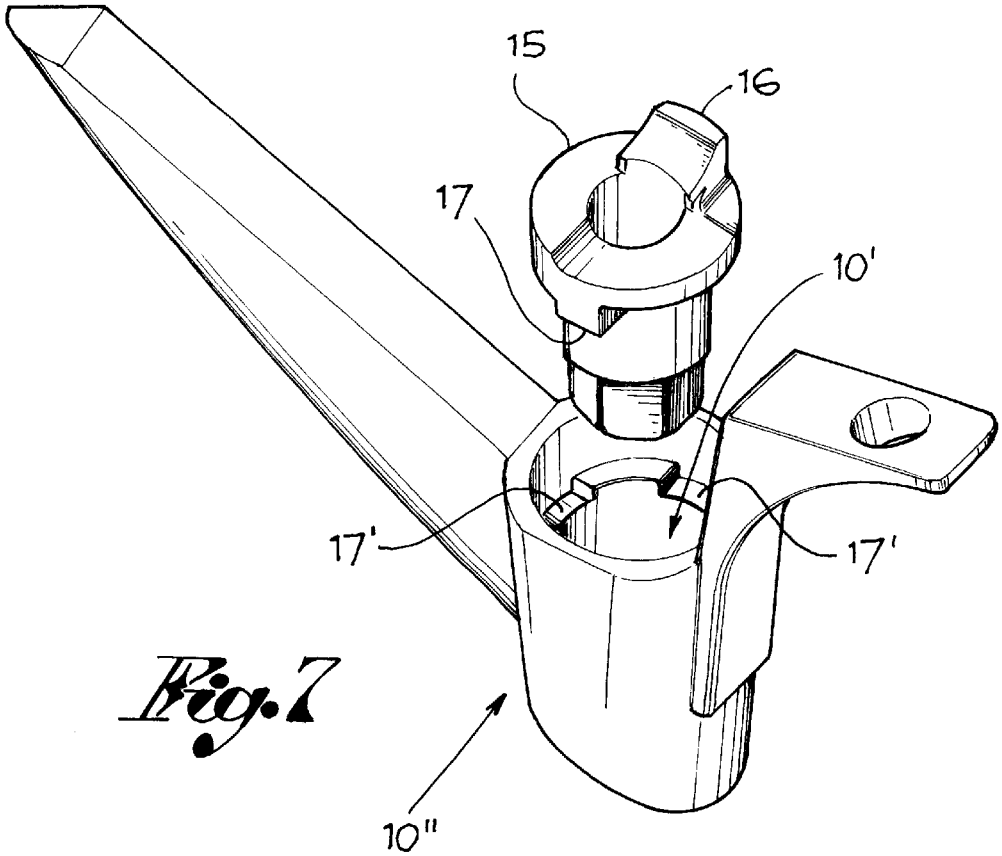
FIG. 7 is a perspective exploded view of the safety device body arranged in the steel insert.
Figure 8:
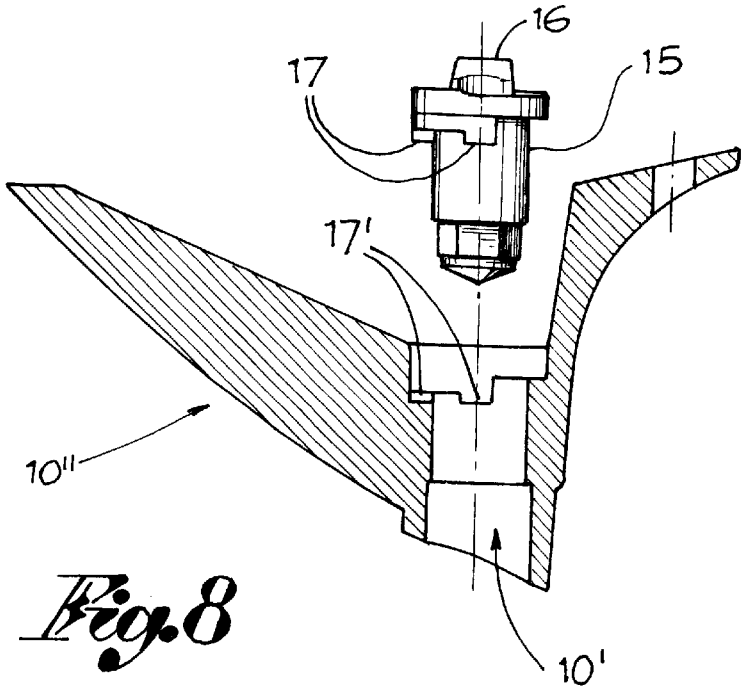
FIG. 8 is a cross-sectional view of the safety device body arranged in the steel insert.

In practice the supplementary safety device is in the unlocked position when the safety device body 15 is turned in such a way that the arrest tooth or cam 16 is in the median transversal plane of the safety device pin 11', as shown in FIGS. 3 and 4. Thus the hand operated safety catch 11 can be freely shifted in the usual manner from active to inactive position and vice versa. Contrarily, when the safety device body is turned with the key to the locked position, the arrest tooth or cam 16 intercepts the safety device pin 11', as shown in FIGS. 5 and 6, at the level of the surface plate (constituted in the drawings by the right hand button). So if the hand operated safety catch has not been previously shifted to the active position, it is forcibly shifted to that position by the action of the arrest tooth or cam 16; if the hand operated safety catch has already been shifted to the active position, the arrest tooth or cam takes up position for interception of the safety device pin. In any case the return movement to the inactive position, which is to say in which the firearm is ready for use, is prevented until the safety device body is once more turned to the unlocked position, achievable only with the specific key.

What is claimed is:

1. A mechanical safety device perfected for firearms including automatic rifles equipped with a safety catch in the under-barrel grip, in which the safety device comprises:

at least one safety device shaft or pin moveable between an active position disabling use of the firearm and an inactive position enabling functioning of the firearm and, in association with the said safety device pin;

at least one spring loaded selector element to define the active and inactive positions of the safety device pin, alternately;

a safety device body located and held in the under-barrel grip on an axis to intersecting the direction of movement of the safety device pin and revolving around the said pin between a position locking the safety device pin to inhibit its movement from the active to the inactive position, and an unlocking position to permit shifting from the active to the inactive position;

a specific command key to engage and turn the safety device body between the locked and unlocked positions; and at least one blocking tooth or cam on the safety device body to intercept and axially block the safety catch pin at least in that, active position when the safety device body is in the locked position.

2. A mechanical safety device in accordance with claim 1, wherein said safety device body is placed and may revolve in a housing in the under-barrel grip with a key-bit portion for coupling with the command key and an arrest tooth engaging with corresponding arrest notches in the housing to define the extreme positions of locking and unlocking of the safety device body.

3. A mechanical safety device in accordance with claim 1, wherein the spring-loaded selector element is on board the safety device body and is oriented to interact with a complementary part along the safety device pin to define the active and inactive positions of the safety device pin.

4. A mechanical safety device in accordance with claim 1, wherein the safety device body is equipped with a revolving terminal at the key-bit portion.

5. A mechanical safety device in accordance with claim 1, wherein the blocking tooth or cam on the safety device body interacts with a shoulder along the safety device pin to thrust the latter into the active position following rotation of the body towards the locked position and to maintain the safety device pin in the active position when the safety device body is in the locked position.

6. A mechanical safety device in accordance with claim 2, wherein the spring-loaded selector element is on board the safety device body and is oriented to interact with a complementary part along the safety device pin to define the active and inactive positions of the safety device pin.

7. A mechanical safety device in accordance with claim 2, wherein the safety device body is equipped with a revolving terminal at the key-bit portion.

8. A mechanical safety device in accordance with claim 2, wherein the blocking tooth or cam on the safety device body interacts with a shoulder along the safety device pin to thrust the latter into the active position following rotation of the body towards the locked position and to maintain the safety device pin in the active position when the safety device body is in the locked position.

9. A mechanical safety device for a firearm, the safety device comprising:

a safety pin moveable between an active position disabling use of the firearm and an inactive position enabling the firearm;

a spring loaded selector element to alternately bias the safety pin into said active and inactive positions;

a safety body arranged around said selector element and in an under-barrel grip of the firearm, said safety body being movable between a locked position and an unlocked position, said locked position being arranged to lock said safety pin in said active position, said unlocked position being arranged to have said safety pin movable between from active position to said inactive position;

a specific command key engageable with, and turnable of, said safety body between said locked and unlocked positions; and a blocking tooth on said safety body to intercept and axially block said safety pin in said active position when said safety body is in said locked position.

* * * * *

UNITED STATES PATENT AND TRADEMARK OFFICE

CERTIFICATE OF CORRECTION

PATENT NO. : 6,550,176 B2
DATED : April 22, 2003
INVENTOR(S) : Gussalli Beretta

It is certified that error appears in the above-identified patent and that said Letters Patent is hereby corrected as shown below:

Title page,
Item [30], Foreign Application Priority Data, insert

-- [30] Jun. 22, 2001 (IT)..... BS2001A000050 --

Signed and Sealed this

Twenty-eighth Day of October, 2003

JAMES E. ROGAN
*Director of the United States Patent and Trademark Office*